US006541953B2

(12) United States Patent
Yoo et al.

(10) Patent No.: US 6,541,953 B2
(45) Date of Patent: Apr. 1, 2003

(54) APPARATUS FOR DETECTING SHAKING OF STROKE OF LINEAR COMPRESSOR AND METHOD THEREFOR

(75) Inventors: Yoo Jae Yoo, Gwangmyung (KR); Jae Chun Lee, Seoul (KR); Min Kyu Hwang, Gwangmyung (KR); Chel Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/989,396

(22) Filed: Nov. 21, 2001

(65) Prior Publication Data

US 2002/0093327 A1 Jul. 18, 2002

(30) Foreign Application Priority Data

Nov. 28, 2000 (KR) ..... 00-71301

(51) Int. Cl.[7] ..... G01R 23/00; F04B 49/06
(52) U.S. Cl. ..... 324/76.52; 417/44.11
(58) Field of Search ..... 324/76.52, 76.77, 324/522; 417/44.1, 44.11, 45, 416–418, 395, 212; 62/6, 160; 310/12; 318/121

(56) References Cited

U.S. PATENT DOCUMENTS 4,613,285 A * 9/1986 Sato et al. ..... 417/214
5,015,153 A * 5/1991 Uesugi et al. ..... 417/44
5,980,211 A * 11/1999 Tojo et al. ..... 417/45

* cited by examiner

*Primary Examiner*—Christine Oda
*Assistant Examiner*—Amy He
(74) *Attorney, Agent, or Firm*—Fleshner & Kim, LLP

(57) ABSTRACT

An apparatus for detecting shaking of stroke of a linear compressor and a method are provided. A linear compressor mis-operates due to change in an external voltage or noise because the shaking of the stroke is detected by the amounts of change in the stroke or current. In order to solve the above problem, a control apparatus of a compressor includes a stroke/current phase difference calculator for calculating the phase differences of the stroke and current using the stroke and the current, which are determined by the increase and the reduction of the stroke due to the voltage generated by a linear compressor, a phase difference change amount calculator for calculating phase difference change amounts using the calculated phase differences of the stroke and the current, a shaking detector for comparing the calculated phase difference change amounts with a reference value for determining whether the shaking of the stroke is detected, to thus determine the shaking of the stroke, and a stroke controller for receiving a stroke shaking detection signal from the stroke shaking detector and changing the stroke voltage according to the magnitude of the request of cooling capacity, which is determined by the change in load, to thus control the driving of the linear compressor, during the operation of the linear compressor.

14 Claims, 4 Drawing Sheets

APPARATUS FOR DETECTING SHAKING OF STROKE OF LINEAR COMPRESSOR AND METHOD THEREFOR

BACKGROUND OF THE INVENTION

1. Field of the Invention

The present invention relates to an apparatus for detecting the shaking of stroke of a linear compressor, and more particularly, to an apparatus for detecting the shaking of the stroke of a linear compressor, which is capable of operating a linear compressor at the maximum efficiency point by detecting the shaking of the stroke using the amount of change in the phase differences of the stroke and current, and a method therefor.

2. Description of the Background Art

In general, a compressor increases the pressure of refrigerant vapor so that the refrigerant vapor evaporated by an evaporator can be easily condensed. Refrigerant circulates in a freezer, repeating processes of condensation and evaporation and carries heat from a cold place to a warm place due to the operation of the compressor.

Various types of compressors are used. However, the most efficient compressor is a linear compressor. The linear compressor compresses vapor by a piston that moves reciprocally in a cylinder to thus increase pressure. When the linear compressor is used in a refrigerator or an air conditioner, it is possible to change a compression ratio by changing a stroke voltage applied to the linear compressor, to thus control variable cooling capacity.

FIG. 1 is a block diagram showing the structure of a control apparatus of a conventional linear compressor.

As shown in FIG. 1, the control apparatus of the linear compressor includes a linear compressor 30, for controlling the cooing capacity (the caloric value taken away by surroundings when 1 Kg of refrigerant evaporates, while passing through the evaporator and performing a cooling operation), whose unit is Kcal/Kg, by changing the stroke due to the reciprocating motion of a piston, which is caused by the stroke voltage according to an initial stroke reference value, a voltage/current detector 40 for detecting the voltage and the current generated by the linear compressor 30 as the stroke increases due to the stroke voltage, a stroke calculator 50 for calculating the stroke using the voltage and the current detected from the voltage/current detector 40, a comparator 10 for receiving the stroke reference value calculated by the stroke calculator 50 at a predetermined point of time and the initial stroke reference value, comparing the stroke reference value with the initial stroke reference value, and outputting a comparison signal, and a stroke controller 20 for increasing or decreasing the stroke voltage according to the comparison signal of the comparator and applying the stroke voltage to the linear compressor 30.

In the linear compressor according to the conventional technology, the principle of the operation of the apparatus for detecting the shaking of the stroke will now be described with reference to FIG. 1.

When the stroke voltage according to the initial stroke reference value set by a user is output, the stroke varies according to the reciprocating motion of the piston inside the cylinder of the linear compressor 30. Accordingly, refrigerant gas inside the cylinder is discharged to a condenser through a discharge valve, to thus control the cooling capacity of the linear compressor. At this time, the voltage/current detector 40 detects the voltage and the current generated by the linear compressor 30 as the stroke increases due to the stroke voltage of the stroke controller 20 and inputs the detected voltage an current to the stroke calculator 50. Then, the stroke calculator 50 calculates the stroke at the predetermined point of time using the voltage and the current, which are detected by the voltage/current detector 40 and outputs the calculated value to the comparator 10.

The stroke is calculated as follows.

$$STROKE = \frac{1}{\alpha}\int\left(V_M - R_{ac}i - L\frac{di}{dt}\right)dt$$

wherein, $\alpha$, $V_M$, $R_{ac}$, and $$L\frac{di}{dt}$$

refer to a constant for converting electrical force into mechanical force, a voltage between both ends of a motor, a loss value due to resistance such as copper loss and core loss, and a voltage applied to an inductor in the motor, respectively.

The comparator 10 compares the stroke at the predetermined point of time, which is output from the stroke calculator 50 with the initial stroke reference value set by the user and inputs the comparison value to the stroke controller. The stroke controller 20 changes the stroke voltage according to the comparison value and applies the stroke voltage to the linear compressor 30.

At this time, the stroke controller 20 increases the stroke voltage when the stroke at the predetermined point of time, which is calculated by the stroke calculator 50, is smaller than the initial stroke reference value and reduces the stroke voltage when the stroke at the predetermined point of time is larger than the initial stroke reference value, to thus control the stroke voltage applied to the linear compressor 30.

The stroke controller 20 obtains difference between the previous stroke value of the linear compressor 30 and the stroke value at the predetermined point of time and determines that the shaking of the stroke (a phenomenon where the performance of the piston becomes unstable due to the characteristic of the compressor when the same input is applied by the specific stroke in a state where disturbance, that is, change in a voltage or noise does not exist) when the difference is no less than a reference value for determining whether the shaking of the stroke is detected. The stroke controller 20 obtains the difference between the previous current generated by the linear compressor 30 and the current at the predetermined point of time and determines that the shaking of the stroke occurs when the difference is no less than the reference value for determining whether the shaking of the stroke is detected. Accordingly, the stroke controller 20 increases or reduces the stroke voltage applied to the linear compressor 30.

That is, when the shaking of the stroke is detected in the air conditioner or the refrigerator that requires the large cooling capacity due to the controlling of a temperature by a user, the stroke controller 20 increases the stroke voltage so that the linear compressor 30 operates right above an area, in which the stroke shakes. When the shaking of the stroke is detected in the case where the small cooling capacity is required, the stroke controller 20 reduces the stroke voltage so that the linear compressor 30 operates right below the area, in which the stroke shakes.

However, according to the control apparatus of the conventional linear compressor, the maximum efficiency point of the operation of the compressor cannot be found out due to the change in an external voltage or external noise without being caused by the characteristic of the compressor because the shaking of the stroke is detected by the amount of change in the stroke or the current.

SUMMARY OF THE INVENTION

Therefore, an object of the present invention is to provide an apparatus for detecting the shaking of stroke of a linear compressor, which is capable of preventing the linear compressor from mis-operating due to change in an external voltage or noise by detecting the shaking of the stroke by the amount of change in the phase differences of the stroke and current, and a method therefor.

Another object of the present invention is to provide an apparatus for detecting the shaking of stroke of a linear compressor, which is capable of preventing the linear compressor from mis-operating due to change in an external voltage or noise by detecting the shaking of the stroke by the amount of change the phase differences of a voltage and current, and a method therefor.

Still another object of the present invention is to provide an apparatus for detecting the shaking of stroke of a linear compressor, which is capable of preventing the linear compressor from mis-operating due to change in an external voltage or noise by detecting the shaking of the stroke by the amount of change the phase differences of speed and current, and a method therefor.

To achieve these and other advantages and in accordance with the purposes of the present invention, as embodied and broadly described herein, there is provided a control apparatus of a compressor, comprising a stroke/current phase difference calculator for calculating the phase differences of the stroke and current using the stroke and the current, which are determined by the increase and the reduction of the stroke due to the voltage generated by a linear compressor, a phase difference change amount calculator for calculating phase difference change amounts using the calculated phase differences of the stroke and the current, a shaking detector for comparing the calculated phase difference change amounts with a reference value for determining whether the shaking of the stroke is detected, to thus determine the shaking of the stroke, and a stroke controller for receiving a stroke shaking detection signal from the stroke shaking detector and changing the stroke voltage according to the magnitude of the request of cooling capacity, which is determined by the controlling of a temperature by a user, to thus control the driving of the linear compressor, during the operation of the linear compressor.

There is provided a method for detecting shaking of stroke of a linear compressor, comprising the steps of (a) calculating phase difference change amounts using the phase differences of stroke and current, (b) comparing the absolute values of the calculated phase difference change amounts with a reference value for determining whether the shaking of the stroke is detected; and (c) determining the shaking of the stroke by the step (b), changing a stroke voltage according to the magnitude of required cooling capacity, which is determined by the controlling of a temperature by a user, and driving the linear compressor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
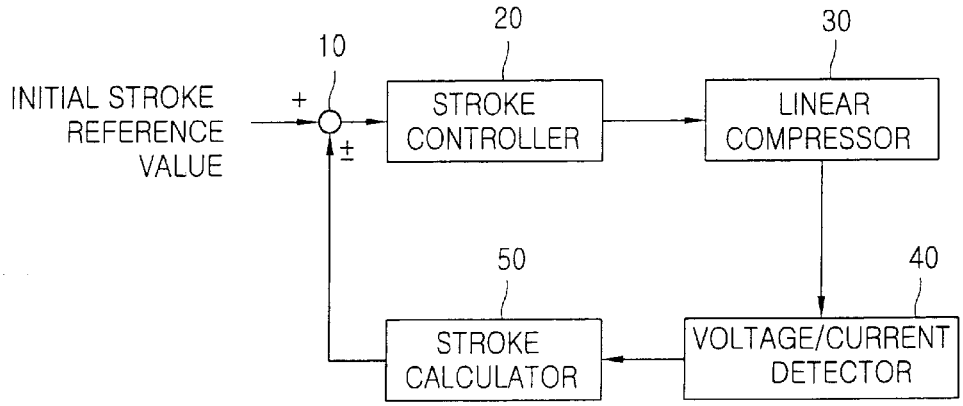
FIG. 1 CONVENTIONAL ART
FIG. 1 is a block diagram showing the structure of an apparatus for controlling stroke of a conventional linear compressor.
Figure 2:
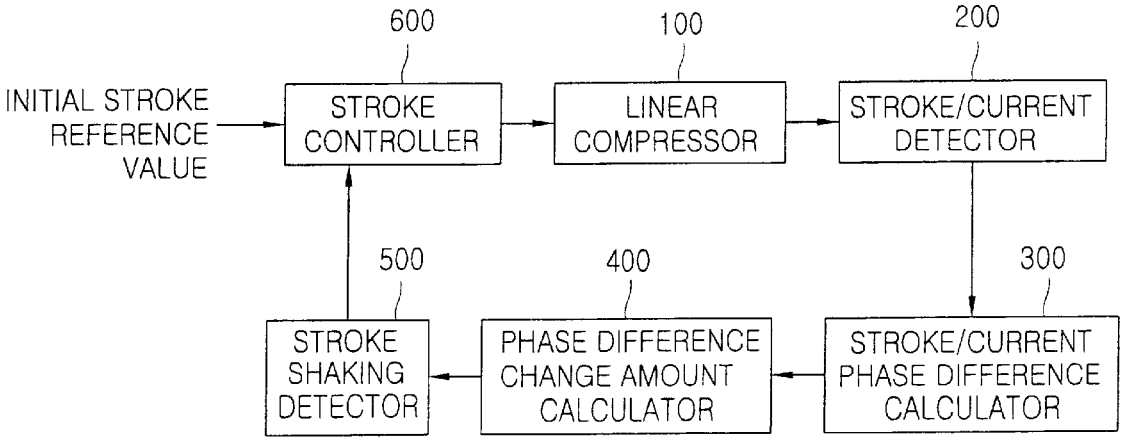
FIG. 2 is a block diagram showing the structure of an apparatus for controlling the stroke of a linear compressor according to the present invention.

FIG. 2 is a block diagram showing the structure of an apparatus for controlling stroke of a linear compressor according to the present invention. The apparatus for controlling the stroke of the linear compressor includes a stroke/current phase difference calculator 300 for calculating the phase differences of the stroke and current using the stroke and the current, which are determined by the increase and the reduction of the stroke due to the voltage generated by a linear compressor 100, a phase difference change amount calculator 400 for calculating phase difference change amounts using the calculated phase differences of the stroke and the current, a shaking detector 500 for comparing the calculated phase difference change amounts with a reference value for determining whether the shaking of the stroke is detected, to thus determine the shaking of the stroke, and a stroke controller 600 for receiving a stroke shaking detection signal from the stroke shaking detector 500 and changing the stroke voltage according to the magnitude of the request of cooling capacity, which is determined by the controlling of a temperature by a user, to thus control the driving of the linear compressor 100, during the operation of the linear compressor 100.

The operation and the effect of the apparatus for detecting the shaking of the stroke of the linear compressor according to the present invention will be described in detail with reference to FIG. 3.

Figure 3:
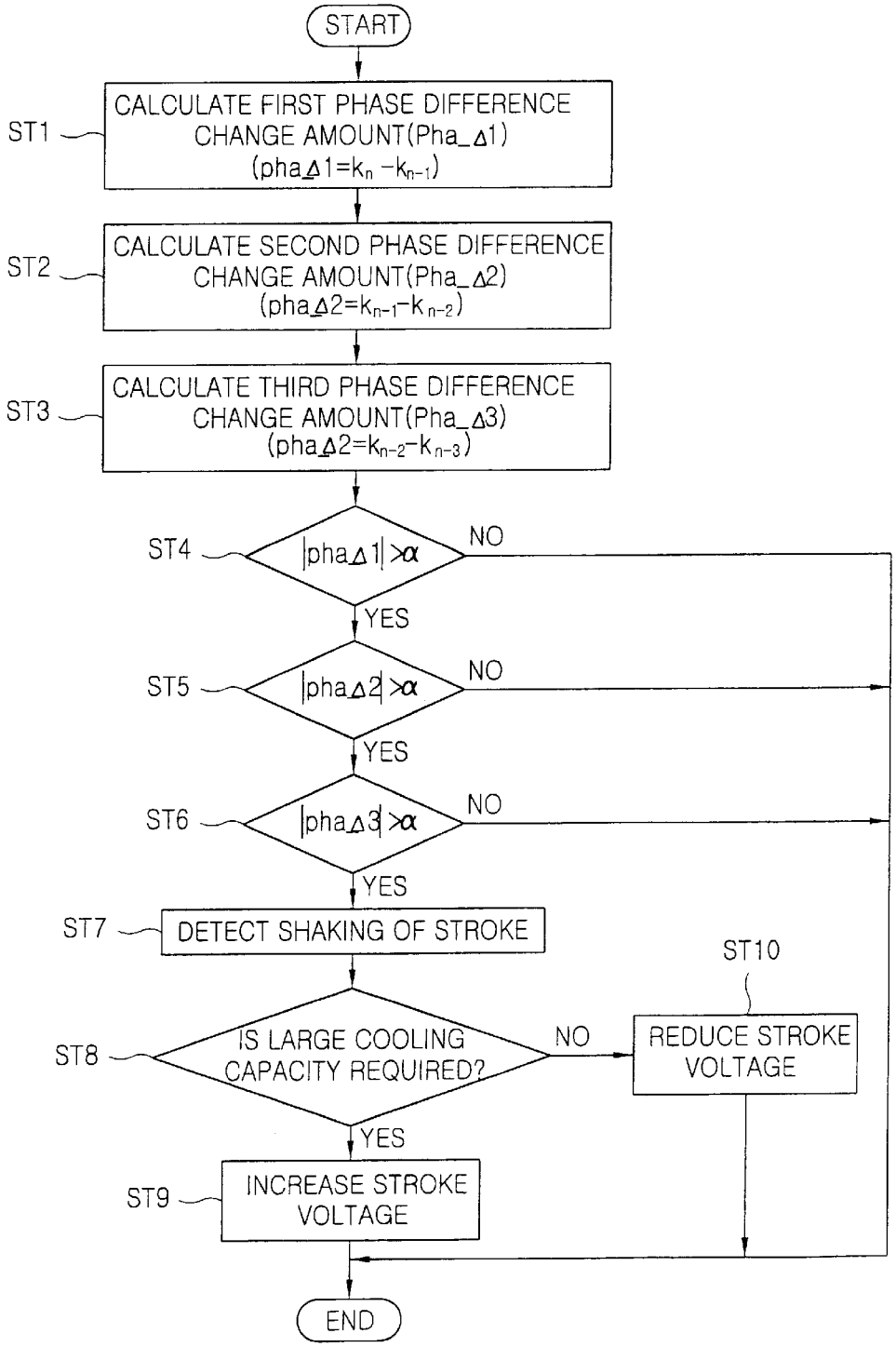
FIG. 3 is a flowchart showing the operation of a method for controlling the stroke of the linear compressor according to the present invention.

FIG. 3 is a flowchart showing the operation of a method for controlling the stroke of the linear compressor according to the present invention.

A piston is in an up-and-down motion by a stroke voltage that is applied so that a top dead center (TDC) becomes '0' to thus drive the linear compressor 100 at the maximum efficiency point. Accordingly, the stroke varies and the cooling capacity is controlled.

At this time, the stroke/current detector 200 calculates the stroke/the current using the voltage and the current, which are generated by the linear compressor 100, as the stroke increases due to the stroke voltage and outputs the stroke/the current.

The stroke/current phase difference calculator 300 receives the stroke/the current output from the stroke/current detector 200 and detects the phase differences of the stroke/the current at the point of time corresponding to the stroke and the current.

The phase difference change amount calculator 400 calculates first, second, and third phase difference change amounts Pha-Δ1, Pha-Δ2, and Pha-Δ3 by repeatedly subtracting the phase difference of the stroke/the current, which are detected at a predetermined point of time, from the phase differences of the stroke/the current, which are previously detected (ST1 through ST3).

The stroke-shaking detector 500 determines whether the absolute value of the first phase difference change amount Pha-Δ1, which is calculated by the phase difference change amount calculator 400, is larger than the reference value (the value that is a reference for determining whether the shaking of the stroke is detected) (ST4). When the absolute value of the first phase difference change amount Pha-Δ1 is larger than the reference value, the stroke-shaking detector 500 determines whether the absolute value of the second phase difference change amount Pha-Δ2, which is calculated by the phase difference change amount calculator 400, is larger than the reference value (ST5). When the absolute value of the second phase difference change amount Pha-Δ2 is larger than the reference value, the stroke-shaking detector 500 determines whether the absolute value of the third phase difference change amount Pha-Δ3, which is calculated by the phase difference change amount calculator 400, is larger than the reference value (ST6). When the first, second, and third phase difference change amounts Pha-Δ1, Pha-Δ2, and Pha-Δ3 are larger than the reference value, the stroke shaking detector 500 determines that the linear compressor 100 is in the state of the shaking of the stroke, detects the degree of the shaking of the stroke, and inputs the stroke shaking detection signal to the stroke controller 600 (ST7).

As mentioned above, the shaking of the stroke is detected by comparing the first, second, and third phase difference change amounts Pha-Δ1, Pha-Δ2, and Pha-Δ3 with the reference value for determining whether the shaking of the stroke is detected. The number of detections of the phase difference change amounts, which is three, is the minimum number for detecting the shaking of the stroke and is the optimal number verified by experiments.

However, it is possible to more appropriately determine the degree of the shaking of the stroke by detecting the phase difference change amounts four, five, or more times and comparing the detected phase difference change amounts with the reference value.

The stroke controller 600 controls the driving of the linear compressor 100 by the initial stroke reference value at the initial time of the driving of the linear compressor 100 and changes the stroke voltage according to the magnitude of the request of the cooling capacity when the stroke shaking detection signal is received from the stroke shaking detector 500, to thus control the driving of the linear compressor 100.

For example, the stroke controller 600 increases the stroke voltage so that the linear compressor 100 can be driven right above the area, in which the stroke shakes, when the large cooling capacity is required by the linear compressor 100 due to the controlling of a temperature by the user. The stroke controller 600 reduces the stroke voltage so that the linear compressor 100 can be driven right below the area, in which the stroke shakes, when the small cooling capacity is required by the linear compressor 100. Accordingly, the linear compressor 100 can be driven by the maximum efficiency point.

When all of the first, second, and third phase difference change amounts Pha-Δ1, Pha-Δ2, and Pha-Δ3 are not larger than the reference value, it is determined that the linear compressor 100 is stably driven. Accordingly, all of the control operations according to the method for detecting the stroke of the linear compressor 100 are terminated.

The stroke controller 600 determines whether the linear compressor 100 requires the large cooling capacity and, as a result, if the large cooling capacity is required due to the controlling of the temperature of the user (ST8), the stroke controller increases the stroke voltage so that the linear compressor 100 can be driven right above the area, in which the stroke shakes (ST9).

When the linear compressor 100 does not satisfy the above condition, that is, the small cooling capacity is required by the linear compressor 100, the stroke controller 600 reduces the stroke voltage so that the linear compressor 100 can be driven right below the area, in which the stroke shakes (ST10), to thus drive the linear compressor 100 at the maximum efficiency point. All of the control operations according to the method for controlling the stroke of the linear compressor 100 are terminated.

Figure 4:
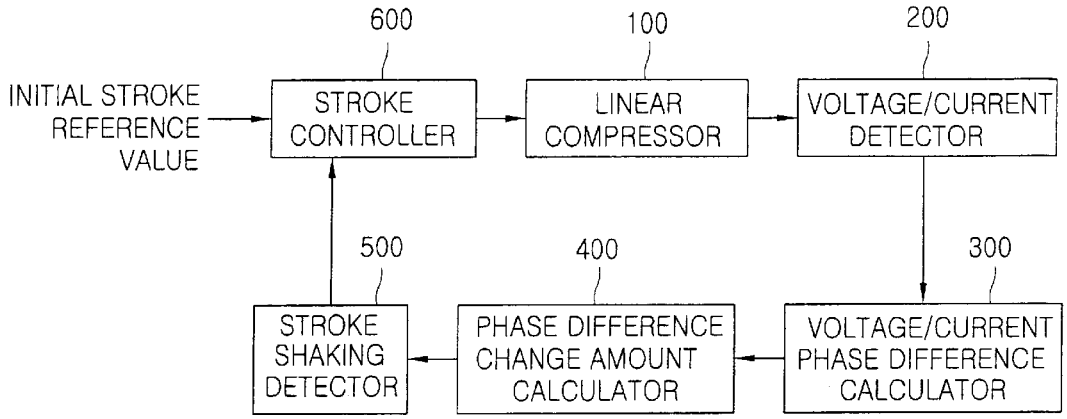
FIG. 4 shows the structure of another embodiment of an apparatus for controlling the stroke of the linear compressor according to the present invention.

In the above processes, the phase differences of the stroke and the current are used in order to detect the shaking of the stroke. However, the phase differences of the voltage and the current can be used, which is shown in FIG. 4. Also, the phase differences of the speed (the speed of the piston) and the current can be used, which is shown in FIG. 5.

FIG. 4 shows another embodiment of the apparatus for controlling the stroke of the linear compressor according to the present invention. The voltage/the current phase difference calculator 300 calculates the phase differences of the voltage and the current using the voltage and the current, which are generated by the linear compressor 100 and detected by the voltage/the current detector 40.

Figure 5:
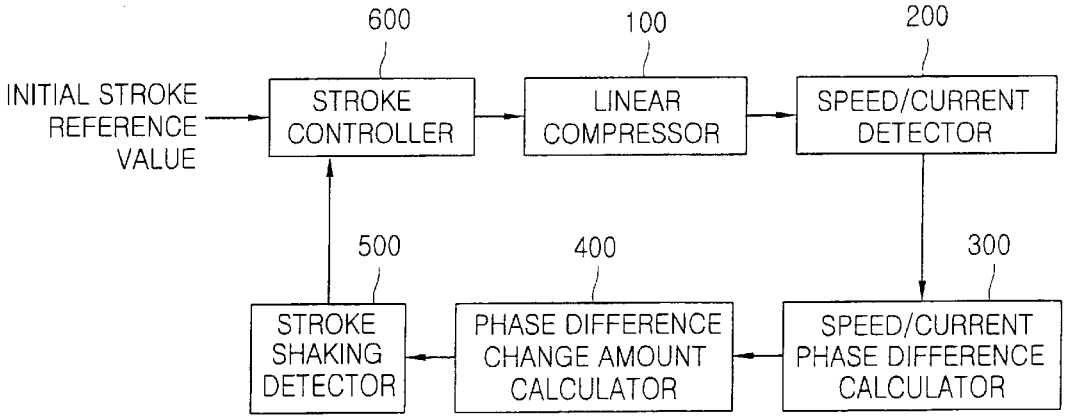
FIG. 5 shows the structure of still another embodiment of the apparatus for controlling the stroke of the linear compressor according to the present invention.

FIG. 5 shows still another embodiment of the apparatus for controlling the stroke of the linear compressor according to the present invention. The voltage/the current phase difference calculator 300 calculates the phase differences of the voltage and the current using the speed of the piston in the linear compressor and the current generated by the linear compressor 100 and detected by the voltage/the current detector 40.

The speed of the piston is calculated as follows.

$$\text{Velocity} = V_M - R_{ac} i - L\frac{di}{dt}$$

wherein, $V_M$, $R_{ac}$, and $$L\frac{di}{dt}$$

refer to a voltage between both ends of a motor, a loss value due to resistance such as copper loss or core loss, and a voltage applied to an inductor in the monitor.

Processes of calculating the phase difference amounts using the phase differences calculated by the above two methods, detecting the shaking of the stroke, and controlling the operation of the linear compressor are the same as the processes described in FIG. 3. Apparatuses used in the processes are the same as the apparatuses shown in FIG. 2.

Figure 6:
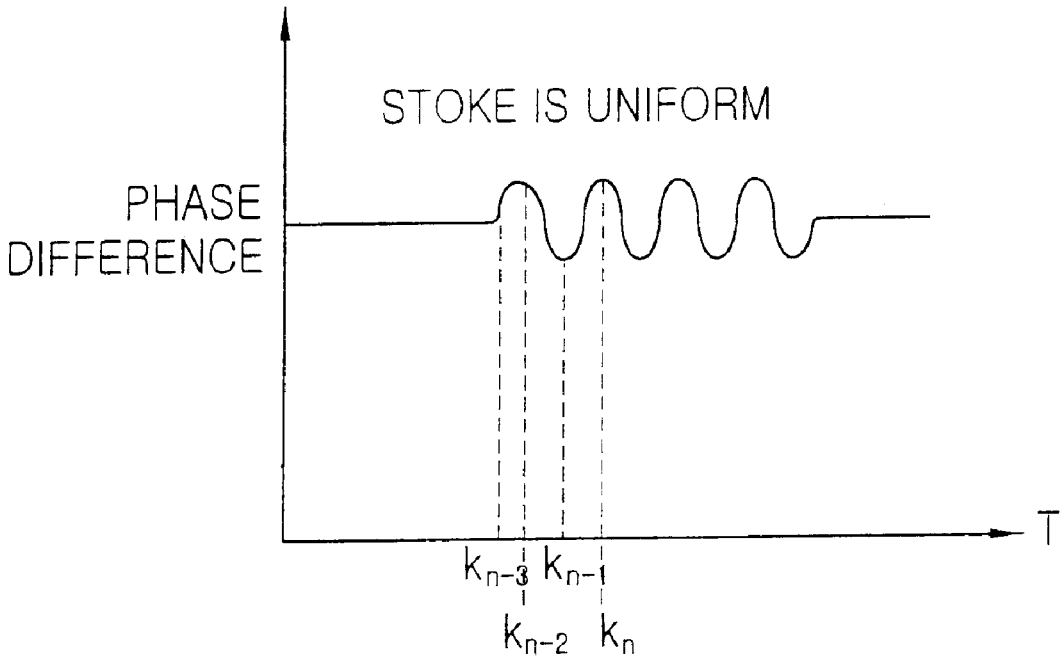
FIG. 6 shows waveforms of the phase differences of the stroke/current for detecting shaking of the stroke in FIG. 2.

FIG. 6 shows waveforms showing the phase differences of the stroke and the current for detecting the shaking of the stroke in FIG. 2.

As shown in FIG. 6, the phase differences of the stroke and the current change due to the shaking of the stroke according to the lapse of time. That is, when uniform stroke is applied, the performance of the piston becomes unstable due to the characteristic of the compressor.

Therefore, as mentioned above, when the linear compressor 100 is driven, the phase difference change amount calculator 400 repeatedly subtracts the phase differences of the stroke and the current, which are detected at a predetermined point of time, from the phase differences of the stroke and the current, which are previously detected, and calculates predetermined phase difference change amounts Pha-Δ1, Pha-Δ2, and Pha-Δ3. The stroke-shaking detector 500 compares the calculated phase difference change amount with the reference value, to thus determine the state of the shaking of the stroke of the linear compressor 100.

Therefore, according to the present invention, it is possible to operate the linear compressor at the maximum efficiency point by detecting the shaking of the stroke by the amounts of change in the phase differences of the stroke and the current, to thus prevent the linear compressor from mis-operating due to change in an external voltage or noise.

What is claimed is:

1. A control apparatus of a compressor, comprising:

a stroke/current phase difference detector for detecting the phase differences of stroke and current using the stroke and the current, which are determined by the increase and the reduction of a stroke due to a voltage applied to a linear compressor;

a phase difference change amount calculator for calculating phase difference change amounts using the detected phase differences of the stroke and the current;

a stroke shaking detector for comparing the calculated phase difference change amounts with a reference value for determining whether the shaking of the stroke is detected, to thus determine the shaking of the stroke; and a stroke controller for receiving a stroke shaking detection signal from the stroke shaking detector and changing the applied voltage according to the magnitude of the request of cooling capacity, which is determined by the change of load, to thus control the driving of the linear compressor, during the operation of the linear compressor.

2. A control apparatus of a compressor, comprising:

a voltage/current detector for detecting the voltage and the current, which are generated by a linear compressor;

a voltage/current phase difference detector for calculating the phase differences of the voltage and the current using the voltage and the current;

a phase difference change amount calculator for calculating phase difference change amounts using the detected phase differences of the stroke and the current;

a stroke shaking detector for comparing the calculated phase difference change amounts with a reference value for determining whether the shaking of the stroke is detected, to thus determine the shaking of the stroke; and a stroke controller for receiving a stroke shaking detection signal from the stroke shaking detector and changing the applied voltage according to the magnitude of the request of cooling capacity, which is determined by the change of load, to thus control the driving of the linear compressor, during the operation of the linear compressor.

3. A control apparatus of a compressor, comprising:

a speed/current detector for detecting the speed of a piston in the linear compressor and the current generated by the linear compressor;

a speed/current phase difference calculator for calculating the phase differences of the speed and the current using the speed and the current;

a phase difference change amount calculator for calculating phase difference change amounts using the detected phase differences of the speed and the current;

a stroke shaking detector for comparing the calculated phase difference change amounts with a reference value for determining whether the shaking of the stroke is detected, to thus determine the shaking of the stroke; and a stroke controller for receiving a stroke shaking detection signal from the stroke shaking detector and changing the applied voltage according to the magnitude of the request of cooling capacity, which is determined by the change of load, to thus control the driving of the linear compressor, during the operation of the linear compressor.

4. The apparatus of claim 1, wherein the phase difference change amount calculator subtracts the detected phase differences of the stroke and the current from the phase differences of the stroke and the current, which are previously detected by the phase difference detector, to thus calculate first, second, and third phase difference change amounts.

5. The apparatus of claim 4, wherein the first phase difference change amount is calculated by subtracting the phase differences of first stroke and the current from the detected phase difference of the stroke and the current.

6. The apparatus of claim 4, wherein the second phase difference change amount is calculated by subtracting the phase difference of second stroke and the current from the phase differences of the first stroke and the current.

7. The apparatus of claim 4, wherein the third phase difference change amount is calculated by subtracting the phase differences of third stroke and the current from the phase differences of the second stroke and the current.

8. The apparatus of claim 1, wherein the stroke shaking detector determines that the linear compressor is in the state of the shaking of the stroke when the first, second, and third phase difference change amounts calculated by the phase difference change amount calculator are larger than the reference value, detects the degree of the shaking of the stroke, and outputs a stroke shaking detection signal to the stroke controller.

9. The apparatus of claim 1, wherein the stroke controller increases the stroke voltage so that the linear compressor can be driven right above the area, in which the stroke of the linear compressor shakes, when large cooling capacity is required by the linear compressor and reduces the stroke voltage so that the linear compressor can be driven right below the area, in which the stroke of the linear compressor shakes, when small cooling capacity is required by the linear compressor, to thus operate the linear compressor at the maximum efficiency point.

10. A method for detecting shaking of stroke of a linear compressor, comprising the steps of:

(a) calculating phase difference change amounts using the phase differences of stroke and current;

(b) comparing the absolute values of the calculated phase difference change amounts with a reference value for determining whether the shaking of the stroke is detected; and (c) determining the shaking of the stroke by the step (b), changing a stroke voltage according to the magnitude of required cooling capacity, which is determined by the controlling of a temperature by a user, and driving the linear compressor.

11. The method of claim 10, wherein the step (a) comprises the steps of:

(a1) calculating a first phase difference change amount by subtracting the phase differences of the first stroke and the current from the phase difference of the stroke and the current;

(a2) calculating a second phase difference change amount by subtracting the phase differences of the second stroke and the current from the phase differences of the first stroke and the current; and (a3) calculating a third phase difference change amount by subtracting the phase differences of the third stroke and the current from the phase differences of the second stroke and the current.

12. The method of claim 10, wherein the step (c) comprises the steps of:

(c1) sequentially comparing the phase difference change amounts with the reference value and determining whether the absolute values of the phase difference change amounts are larger than the reference value;

(c2) determining that the shaking of the stroke occurs and outputting the stroke shaking detection signal when all of the absolute values of the phase difference change amounts are larger than the reference value; and (c3) receiving the stroke shaking detection signal, changing the stroke voltage according to the magnitude of the required cooling capacity, which is determined by the controlling of the temperature by the user, and controlling the operation of the linear compressor.

13. The method of claim 12, wherein the step (c2) further comprises the step of terminating the control operation of the linear compressor according to the method for detecting the shaking of the stroke when all of the absolute values of the phase difference change amounts are not larger than the reference value.

14. The method of claim 12, wherein the step (c3) further comprises the steps of:

determining the magnitude of the cooling capacity currently required by the linear compressor;

increasing the stroke voltage so that the linear compressor can be driven right above the area, in which the stroke shakes, when the large cooling capacity, which is determined by the controlling of the temperature of the user, is required by the linear compressor; and reducing the stroke voltage so that the linear compressor can be driven right below the area, in which the stroke shakes, when the small cooling capacity is required by the linear compressor.

* * * * *